United States Patent [19]

Johnston et al.

[11] 4,239,946

[45] Dec. 16, 1980

[54] SWITCH OPERATOR WITH SWITCH-MOUNTING ADAPTER

[75] Inventors: Robert J. Johnston, Patterson Heights; Dominic Colista, Harmony Township, Beaver County; Stephen G. Layciak, Brighton Township, Beaver County; Stephen S. Dobrosielski, Beaver, all of Pa.

[73] Assignee: Westinghouse Electric Corp., Pittsburgh, Pa.

[21] Appl. No.: 45,450

[22] Filed: Jun. 4, 1979

[51] Int. Cl.[3] ..... H01R 33/28

[52] U.S. Cl. ..... 200/51.13; 200/296; 200/307

[58] Field of Search ..... 200/296, 340, 51.02, 200/307, 51.08, 51.13

[56] References Cited

U.S. PATENT DOCUMENTS

| | | | |
|---|---|---|---|
| 1,236,553 | 8/1917 | Douglas | 200/51.02 |
| 2,969,443 | 1/1961 | Barden et al. | 200/296 |

FOREIGN PATENT DOCUMENTS

| | | | |
|---|---|---|---|
| 2333327 | 1/1974 | Fed. Rep. of Germany | 200/296 |

*Primary Examiner*—Willis Little

*Attorney, Agent, or Firm*—L. P. Johns

[57] ABSTRACT

A switch operator characterized by a switch operator and at least one switch, and an adapter for mounting the switch on the operator. The adapter and the operator are provided with interfitting bayonet type connections which are engaged and disengaged by rotation of one of the operator and adapter about the axis of the assembly, whereby operation of the actuator longitudinally of the assembly does not disconnect the bayonet-type connections.

5 Claims, 7 Drawing Figures

SWITCH OPERATOR WITH SWITCH-MOUNTING ADAPTER

CROSS-REFERENCE TO RELATED APPLICATIONS

This application is related to the copending applications of R. J. Johnston, Ser. No. 858,325, dated Dec. 17, 1977; W. J. Kellogg, Ser. No. 858,326, filed Dec. 7, 1977; R. J. Johnston, Ser. No. 858,323, filed Dec. 7, 1977; R. J. Johnston, S. S. Dobrosielski and S. G. Layciak, Ser. No. 45,448, filed June 4, 1979, and R. J. Johnston, S. G. Layciak and G. M. Cametti, Ser. No. 45,449, filed June 4, 1979.

BACKGROUND OF THE INVENTION

1. Field of the Invention

This invention relates to electrical switching devices.

2. Description of the Prior Art

Electrical equipment, such as a motor circuit, is controlled by a switch operator in conjunction with a plurality of contacts. In the past, the contact blocks have been attached to the switch operator in various ways, including detachable latching hooks and the like. Ordinarily, latching hooks are secured by moving the contact blocks longitudinally into a locked position from which they may be released manually. Under some conditions, however, such as where undue pressure is applied to the switch operator, the latching hooks become disengaged inadvertently, because the pressure applied is in the direction opposite that for securing the latching hooks together.

SUMMARY OF THE INVENTION

It has been found according to this invention that a problem involved with maintaining switch operator and one or more switch blocks together may be overcome by providing a latching means which requires assembly in a direction other than longitudinal and which comprises movable selector member and a switch-operating element, the element comprising a reciprocable plunger, a tubular housing enclosing the member with one end of the member extending from one end of the housing, the other end of the member having means for actuating the plunger, mounting means for mounting the element on the housing and comprising an adapter, the mounting means also comprising a bayonet-type joint including at least two spaced pins having enlarged heads and corresponding spaced pin- receiving slots, the pins being mounted on the housing and extending longitudinally therefrom, each slot comprising an enlarged portion through which the pin heads pass longitudinally and a reduced portion into which the heads are moved rotatably, and the adapter being comprised of a resilient material whereby the reduced portion yieldingly resists rotation of the pins between the enlarged and the reduced portions.

The advantage of the device of this invention is that the connection between the switch operator and the switch blocks involves movement of the operator and blocks in a direction other than that in which force is applied to operate the switch.

DESCRIPTION OF THE PREFERRED EMBODIMENT

Figure 4:
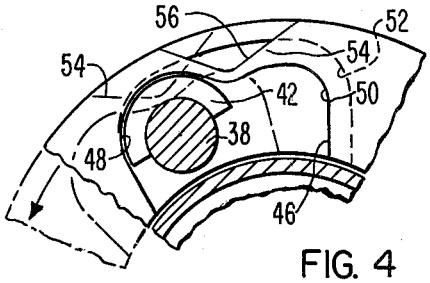
FIG. 4 is a fragmentary sectional view showing an alternate position and taken on a line similar to the line IV—IV of FIG. 1.
Figure 1:
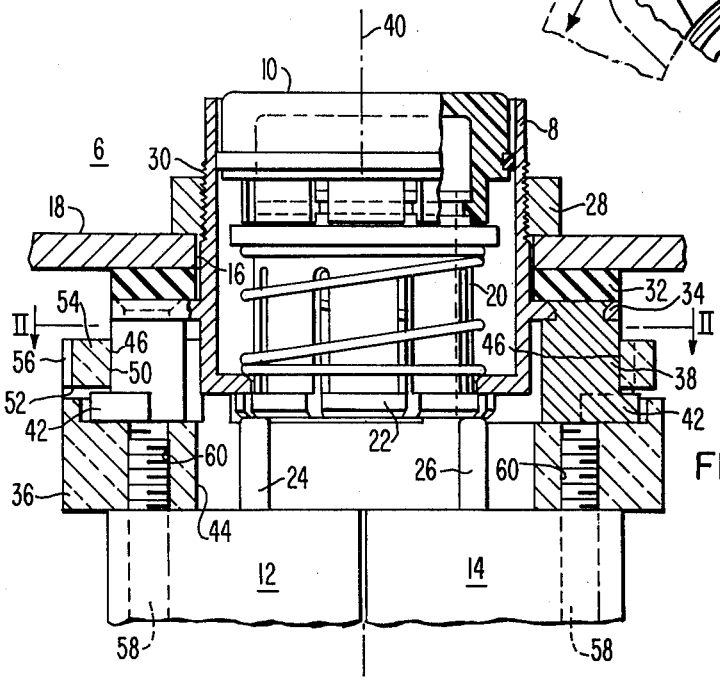
FIG. 1 is an elevational view of an assembly of a switch operator and a pair of contact blocks.

In FIG. 1 a selector switch or operating unit is generally indicated at 6, and it comprises a tubular housing 8, a handle or actuating unit 10, and a pair of contact blocks or switches 12, 14. The housing 8 extends through an aperture 16 in a panel 18 of an enclosure (not shown). The handle 10, being a pushbutton, extends through the tubular housing 8 and comprises a tubular portion 20 the lower end of which is positioned for depressing switch plungers 24, 26 of the switches 12, 14, respectively. The assembly of the operating unit 6 is retained in place on the panel 18 by a clamping ring 28 which is detachably mounted on the outer surface of the housing 8 in a suitable manner such as by threads 30. An annular seal or gasket 32 is disposed between an annular shoulder 34 and panel 18 to prevent leakage of oil from one side of the panel to the other.

In accordance with this invention, mounting means are provided between the housing 8 and the switches 12, 14 which means comprises an annular adapter 36 and a plurality of spaced pins 38 extending from the surface of the shoulder 34 in a direction substantially parallel to the longitudinal axis 40 of the unit 6. The outer ends of the pins 38 are enlarged or provided with flanges 42 which (FIG. 2) extend around each pin 38 for about 180°.

Figure 3:
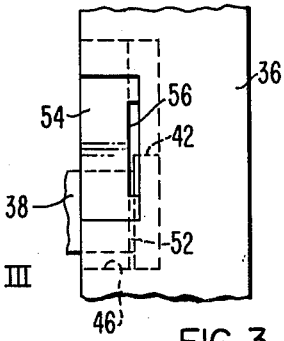
FIG. 3 is a fragmentary elevational view taken on the line III—III of FIG. 2.
Figure 2:
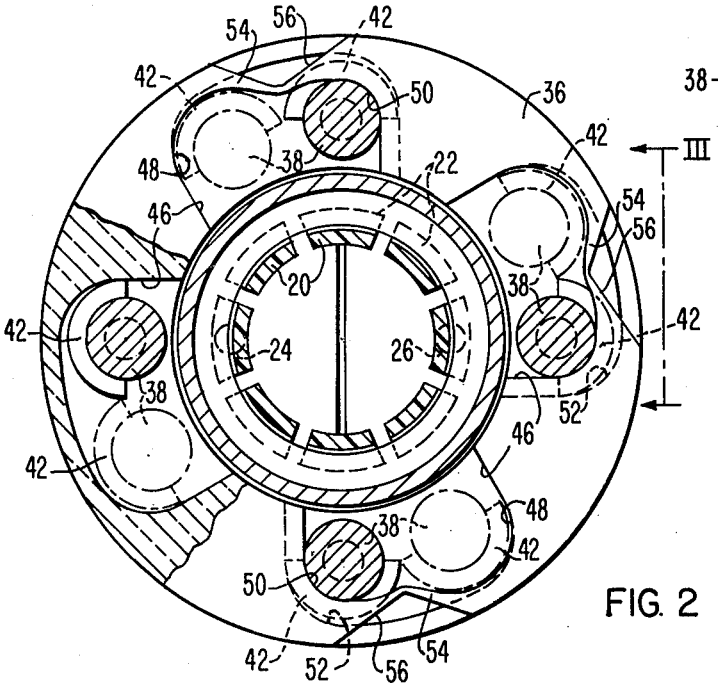
FIG. 2 is a horizontal sectional view taken on the line II—II of FIG. 1.

The adapter 36 comprises a hole 44 in which the tubular portion 20, and plungers 24, 26, are disposed. The adapter 36 also comprises a plurality of pin-receiving slots 46 which include a larger portion 48 (FIG. 2) and a smaller portion 50 at opposite ends of the slot 46. More particularly, the slot 46 comprises an undercut portion 52 in which the flange 42 is located when the adapter 36 is rotated counterclockwise to the locked position (FIGS. 2, 3).

A flexible curved portion 54 of the adapter 36 extends over the undercut portion 52. The portion 54 extends between the body of the adapter 36 and the center portion thereof and is disposed in the path of rotation of the pin 38, so that when the pin moves between the unlatched and the latched positions, the curve portion 54 yieldingly resists the pin movement so that in the latched position the portion 54 locks the pin 38 in place from where it is dislodged only by reverse rotation of substantial manual force to overcome the force applied by the portion 54. For that purpose, the curved portion 54 is a peninsula-like member with opposite ends integral with the body of the adapter 36, and with the outer side of the portion 54 cut away at 56 to enable the portion 54 to be pliable and thereby yielding to movement of the pin 38 as the adapter 36 is rotated between locked and unlocked positions.

Accordingly, with the pins 38 in the locked positions with their respective flanges 42 disposed in the undercut portion 52 of the adapter 36, the adapter is retained in place against the undersurface of the shoulder 34 when the handle 10 is depressed against the plungers 24, 26. Unlike most switch units of prior construction, the application of a longitudinal force on the handle 10 to actuate the plungers 24, 26 is in a direction different from the direction of the force necessary to remove the pins 38 from the latched position.

The blocks or switches 12, 14 are secured to the side of the adapter 36 opposite the unit 10 in a suitable manner, such as by elongated screws 58, the upper ends of which are seated in threaded apertures 60 in the adapter 36.

Figure 5:
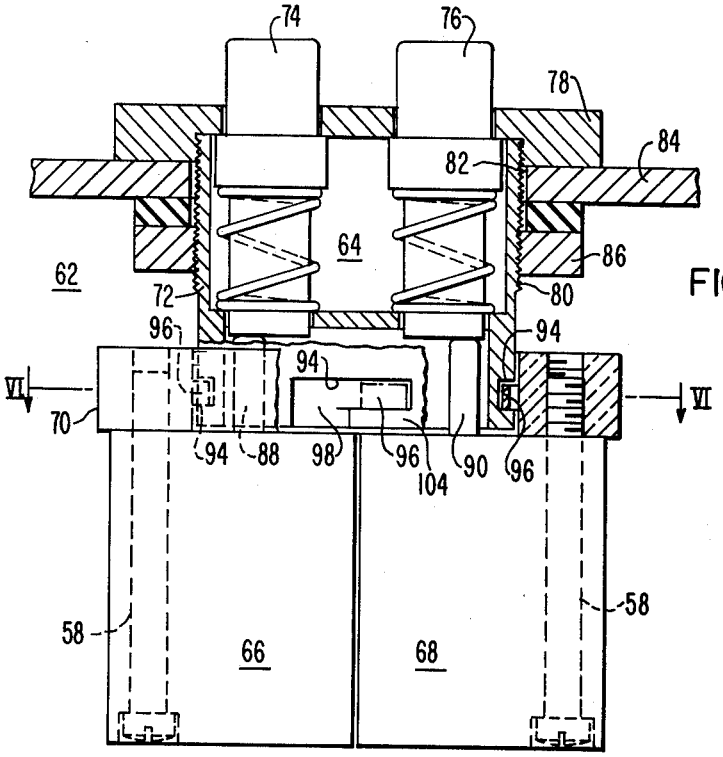
FIG. 5 is an elevational view of an assembly of a switch operator of a second embodiment.
Figure 6:
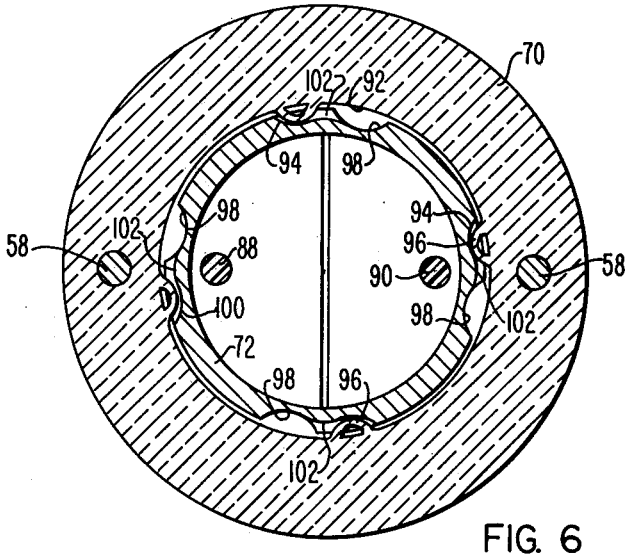
FIG. 6 is a horizontal sectional view taken on the line VI—VI of FIG. 5.
Figure 7:
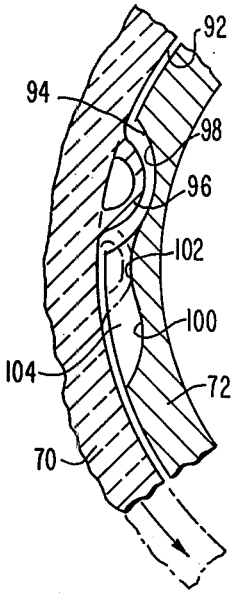
FIG. 7 is an enlarged fragmentary sectional view showing an alternate position and taken on a line similar to the line VI—VI of FIG. 5.

Another embodiment of the invention is shown in FIGS. 5, 6, 7 in which a selector switch is generally indicated at 62 (FIG. 5) and it comprises an operating unit generally indicated at 64, a pair of blocks or switches 66, 68, and an adapter 70 for attaching the switches to the operating unit 64. The operating unit 64 comprises a tubular housing 72, pushbuttons 74, 76, and a mounting or nameplate 78. The tubular housing 72 is preferably cylindrical and has an outer threaded surface 80. The housing 72 is preferably an integral part of the plate 78 and extends through an aperture 82 in a panel 84 where it is secured in place by a clamp ring 86 on the threaded surface 80. Each pushbutton 74, 76 engages a corresponding plunger 88, extending from the switches 66, 68, respectively.

In accordance with this invention, the adapter 70 comprises a circular aperture 92 (FIG. 6) into which the lower end portion of the tubular housing 72 extends. The housing comprises a number of spaced, such as four, slots 94 for locking the adapter 70 onto the lower end portion of the housing 72. Correspondingly, the adapter 70 comprises a number of inturned projections 96 which engage the slots 94. The slots 94 comprise a large portion 98, a small portion 100, and a hump for projection 102 therebetween. The large portion 98 (FIG. 5) extends downwardly from the main portion of the slot 94 to the lower end of the housing 72 to enable insertion of the projection 96 longitudinally into the slot 94. The adapter 70 is then rotated clockwise with the projection 96 of the adapter moving over and being yieldingly deformed by the hump 102. Until upon further rotation the projection 96 moves into the small portion 100 of the notch. In the latter position the projection 96 is locked in place against longitudinal separation of the housing by a housing portion 104. The switch selector 62 of FIG. 5 differs from the switch selector 6 of FIG. 1 in that the former may be mounted from the outer side of the panel (the top side of panel 84 as viewed in FIG. 5), because the housing 72 has a diameter less than that of the aperture 82. The clamping ring 86 is attached from the opposite side of the panel 84. On the other hand the selector switch 6 (FIG. 1) is inserted through the aperture 16 in the panel 18 in the opposite direction, that is, from the bottom to the top side (FIG. 1) with the clamping ring 28 being attached on the top side of the housing 8.

In conclusion, the device of this invention provides latching means for locking an adapter onto a switch actuator by rotating the adapter in a direction different from that in which a load is applied to operate switches mounted on the adapter.

What is claimed is:

1. A switch comprising at least one switch-operating element and a movable selector member, said element comprising a reciprocable plunger, a tubular housing enclosing the member with one end of the member extending from one end of the housing, the other end of the member having means for actuating the plunger, mounting means for mounting the element on the housing and comprising an adapter, the mounting means also comprising a bayonet-type joint including at least two spaced pins having enlarged heads and corresponding spaced pin-receiving slots, the pins and enlarged heads being fixedly mounted in place, one of the pins and slots being on the housing and the other being on the adapter, one of the housing and adapter being rotatable relative to the other to effect locking engagement of the pin heads within the slots, the element being attached to the adapter, the spaced pins extending longitudinally of the switch with the enlarged heads extending radially from the corresponding pins, and each slots having a longitudinally-extending pins-receiving portion and having a head-receiving portion extending radially of the pin-receiving portion, whereby the inner-fitting radially-extending portions retain the housing and adapter against longitudinal separation when said element is actuated.

2. The switch of claim 1 in which the pins are mounted on the housing and extend longitudinally thereform.

3. The switch of claim 1 in which the pins extend from an end surface of the housing opposite said one end thereof.

4. The switch of claim 1 in which the slots comprise an enlarged portion through which the pin heads pass longitudinally and a reduced radially-extending portion into which the heads are moved rotatably.

5. The switch of claim 4 in which the adapter is comprised of a flexible portion and in which the reduced portion yieldingly resists rotation of the pins from the enlarged portion to the reduced portion.

* * * * *